United States Patent [19]

Berwick

[11] 4,387,323

[45] Jun. 7, 1983

[54] PERMANENT MAGNET STRUCTURE FOR LINEAR-BEAM ELECTRON TUBES

[75] Inventor: Albert E. Berwick, San Jose, Calif.

[73] Assignee: Varian Associates, Inc., Palo Alto, Calif.

[21] Appl. No.: 216,590

[22] Filed: Dec. 15, 1980

[51] Int. Cl.[3] ..... H01J 23/08

[52] U.S. Cl. ..... 315/5.35; 315/3.5; 315/5.39

[58] Field of Search ..... 315/5.34, 5.35, 3.5, 315/5.39

[56] References Cited

U.S. PATENT DOCUMENTS

| | | | |
|---|---|---|---|
| 3,153,743 | 10/1964 | Meyerer | 315/5.35 X |
| 3,297,907 | 1/1967 | La Rue et al. | 315/5.35 X |
| 3,366,904 | 1/1968 | Schmidt | 315/5.35 X |
| 3,394,282 | 7/1968 | Schmidt | 315/5.35 |
| 3,450,930 | 6/1969 | Lien | 315/5.35 |
| 3,896,329 | 7/1975 | Lien | 315/5.35 |
| 3,930,182 | 12/1975 | Bretting | 315/5.35 |
| 4,207,494 | 6/1980 | Hatakenaka et al. | 315/5.35 |

FOREIGN PATENT DOCUMENTS

| | | | |
|---|---|---|---|
| 54-48151 | 4/1979 | Japan | 315/5.35 |

*Primary Examiner*—Saxfield Chatmon, Jr.
*Attorney, Agent, or Firm*—Stanley Z. Cole; Richard B. Nelson; Peter J. Sgarbossa

[57] ABSTRACT

High-power linear-beam electron tubes require an extended uniform magnetic field to focus their beam in an elongated cylinder. When permanent magnets are used to energize the magnet structure, there is inevitably a leakage field outside the main flux-return path. The leakage field can refocus the beam in the tube's collector, damaging it. When the collector has air-cooling fins, it is not practical to shield it completely with magnetic material. In the invention, the leakage field is reduced by making the energizing magnet at the collector end axially magnetized and the magnet at the cathode end radially magnetized. Also, a shield around the outside of the fins may be added.

9 Claims, 5 Drawing Figures

PERMANENT MAGNET STRUCTURE FOR LINEAR-BEAM ELECTRON TUBES

DESCRIPTION

1. Field of the Invention

The invention pertains to beam-focusing magnets for linear-beam microwave electron tubes. In linear-beam tubes of high power levels, a uniform magnetic field directed along the beam axis is used to restrain the beam into a cylindrical outline as it transits the wave-interaction structure. After leaving the interaction region, the magnetic field is reduced to zero. The beam expands under its own space-charge repulsion and is collected in an enlarged hollow collector at a low power density. If, however, there is a leakage magnetic field in the collector, it will act as a magnetic lens which can refocus the beam onto a small area of the collector wall which will be overheated. When permanent focusing magnets are used, there are inherent leakage fields outside the primary magnet structure surrounding the linear focused portion of the beam which can adversely affect the desired defocusing in the collector. When the collector has air-cooling fins, magnetic shielding is difficult due to the large openings required for air passage.

2. Prior Art

When focus magnets were made of iron-nickel-cobalt alloys, the low coercive force usually required the length of magnet to be greater than the length of the focused beam. Thus, magnets of horseshoe or C-shape were used, or bowls comprising figures of rotation of these shapes. Shielding the collector from the very large external leakage fluxes of these magnets proved quite difficult. When the collector was water-cooled, an iron shield could be put clear around it, water-cooling channels and all. On the other hand, when the collector had air-cooling fins it was not possible to completely surround it because large apertures were required for input and output of large volumes of air.

Several schemes were tried for putting shielding inside the fins. An iron cylinder between the copper collector body and the copper fins proved to have insufficient thermal conductivity. Iron rods interdigitated between a radially continuous copper structure did not provide adequate shielding.

U.S. Pat. No. 3,450,930 issued June 17, 1969 to E. L. Lien, describes another attempted solution. A small bucking magnet was used to try to cancel out the leakage field. It proved to be difficult to cancel it over a sufficiently long distance.

With the advent of rare-earth-cobalt magnets the high coercive force available removed some restrictions on magnet arrangement. Much more of the magnetic circuit could be made of iron. U.S. Pat. No. 3,896,329 issued July 22, 1975 to Erling L. Lien, describes a symmetric pair of radially magnetized magnets joining an iron yoke to coaxial iron polepieces. Due to the short length of the magnets, the leakage field was reduced below that of iron-nickel-cobalt magnets. However, the leakage problem was still not completely solved.

Another attempt to reduce leakage flux in the collector is illustrated in FIG. 2 to be described later. It is to simply omit the magnet inserted in the collector end of the iron yoke so no leakage flux is generated in that vicinity. With this scheme, it has proved to be very difficult and inefficient to produce a uniform field over the required interaction distance.

SUMMARY OF THE INVENTION

It is a purpose of the invention to provide a permanent focusing magnet structure with very low leakage flux in the collector region.

It is a further purpose to provide a magnet having light weight.

It is a further purpose to provide a magnet using a small quantity of magnetic material.

These purposes are fulfilled by making a nonsymmetric magnet. At the cathode end the magnet material is radially magnetized. This provides the most efficient use of magnet material. At the collector end the magnet material is axially magnetized, placing it farther from the collector and also providing some shielding by the collector polepiece itself which extends to the outer radius of the structure. The reduced leakage field may be further screened out by a flux shield extending from the collector-end polepiece and surrounding the cooling fins.

DESCRIPTION OF THE PREFERRED EMBODIMENTS

Figure 1:
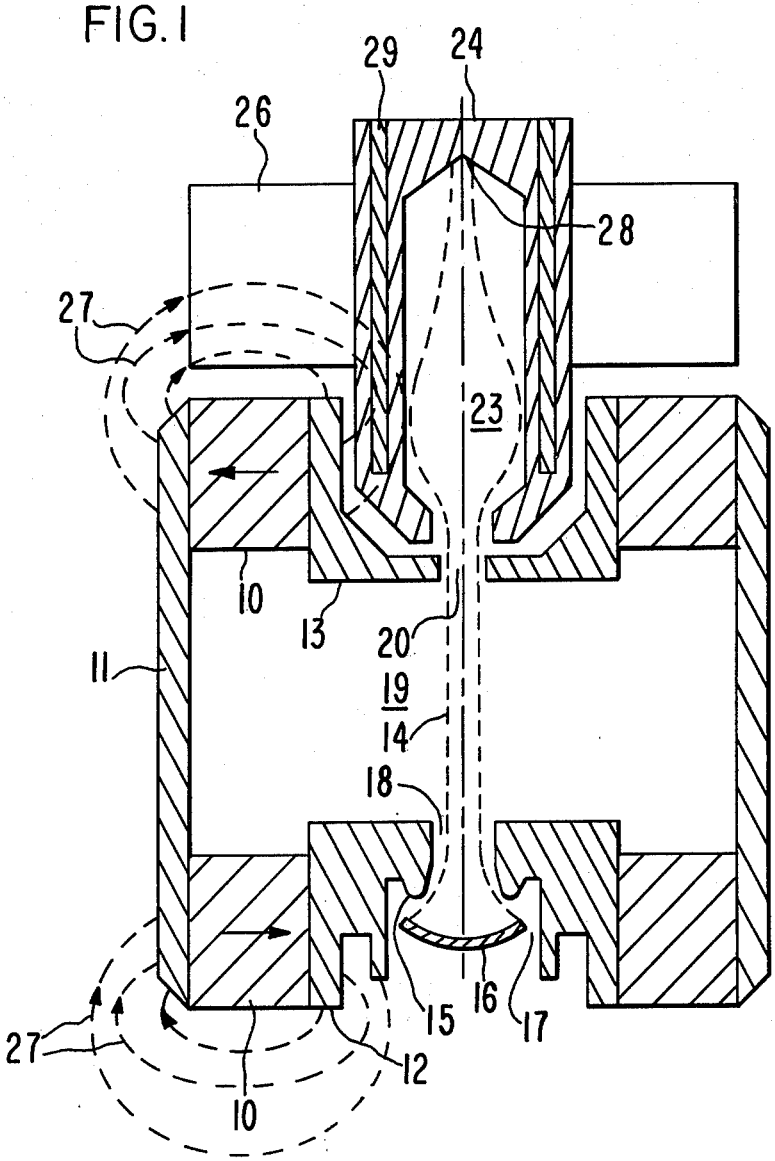
FIG. 1 is a schematic axial section of a prior art permanent magnet structure.

FIG. 1 is a schematic axial section of a prior art magnet structure as described in U.S. Pat. No. 3,896,329. The permanent magnets 10, as of rare-earth-cobalt alloy, are of annular shape, magnetized radially in opposing directions as indicated by the arrows. The return flux path comprises a hollow yoke 11 and a pair of annular polepieces 12, 13 of high-permeability material such as iron or mild steel. The magnet is adapted to focus a linear-beam electron tube. For clarity, only those parts of the tube are shown which are involved in the beam-focusing. Usually some inner parts of polepieces 12, 13 form part of the tube's vacuum envelope. A beam of electrons 14 is drawn by a hollow anode 15 from a concave cathode emitter 16 located in a magnetically shielded cavity 17 in input polepiece 12. It passes through a small entrance aperture 18 in polepiece 12 into a region 19 of relatively uniform field between polepiece 12 and output polepiece 13. This field keeps the beam focussed in a uniform cylindrical pencil while it interacts with a surrounding microwave circuit (not shown) such as a traveling slowwave circuit. The beam 14 leaves uniform-field region 19 thru an exit aperture 20 in output polepiece 13. In the relatively field-free region outside the magnet structure, the beam expands due to the repulsive force of its own space charge and is collected on the hollow inside 23 of a collector 24. Collector 24 is of copper to carry off the heat produced. For air cooling, a spaced array of radial copper fins 26 is attached to the outside of collector 24 and an axial stream of air is blown over them.

The structure of FIG. 1 is capable of producing a satisfactorily uniform field in interaction region 19. However, it generates a large amount of leakage field outside the principal flux circuit. Dotted lines 27 indicate flux lines, some of which pass thru collector cavity 23. This flux forms a convergent electron lens which can refocus beam 14 onto a small spot 28 on collector 24. The increased power density can cause failure.

A prior art scheme to reduce the collector flux is an array of iron rods 29 parallel to the beam axis and embedded in copper collector 24. With the amount of iron required to get adequate shielding, the reduction in thermal conductivity thru collector 24 has proven excessive.

Figure 2:
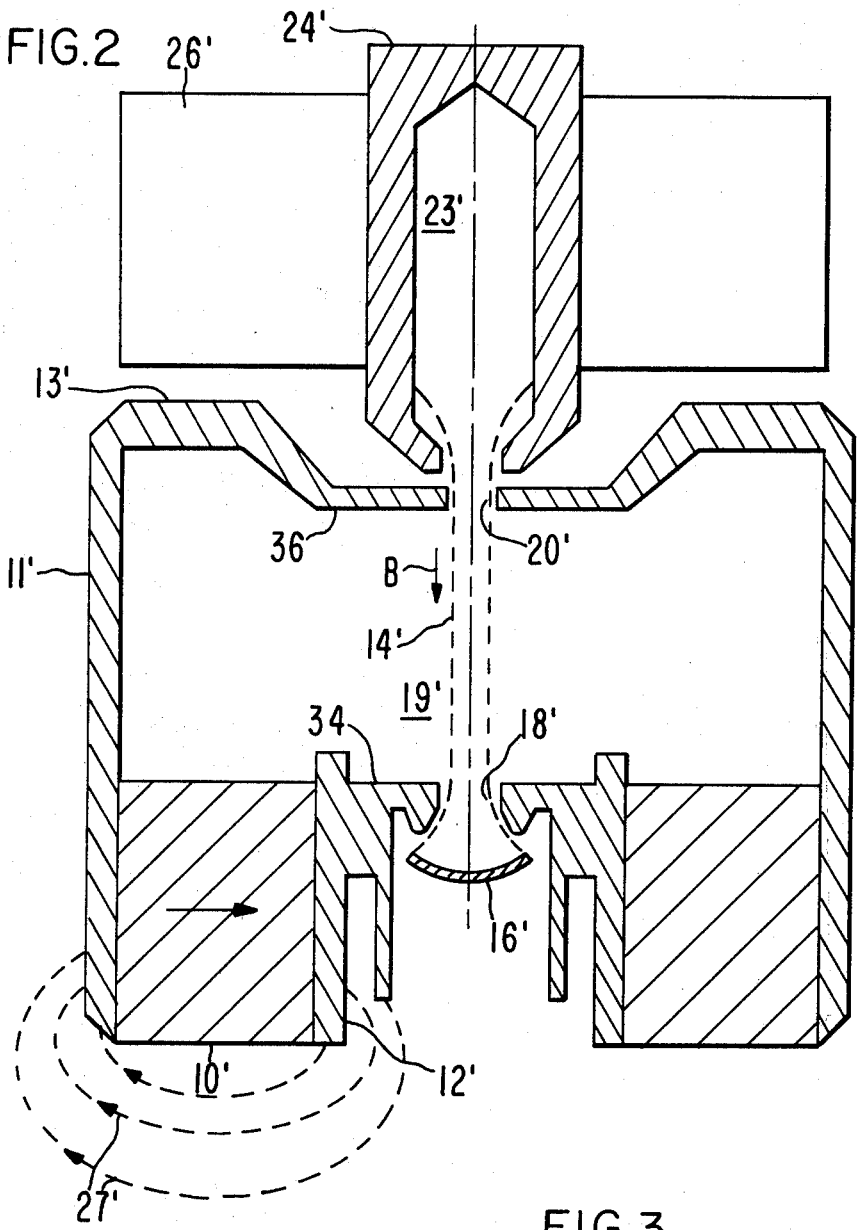
FIG. 2 is a schematic axial section of another prior art permanent magnet structure.

A prior art magnet structure designed to reduce collector flux is illustrated by FIG. 2. The permanent magnet material 10' is a single ring-shaped element, usually made up of a number of tapered segments fitted together around the ring. It is magnetized radially and its inner surface in contact with the polepiece 12' is at the smallest radius consistent with the dimensions of polepiece 12 required for shaping the field in the interaction region 19' and enclosing the electron gun 16'. As taught by U.S. Pat. No. 3,896,329, described above, the radial magnetization provides the most efficient use of the expensive rare-earth-cobalt magnet material.

The amount of leakage flux in the region of the electron gun 16' can be easily controlled by the shape of polepiece 12' which acts as a shield. Similar shielding cannot be provided for collector 24' because magnetically permeable materials such as iron are not good enough thermal conductors to handle the high heat dissipation of collector 24'. In this scheme, the magnetic material 10' is all at the end of the structure farthest removed from collector 24, so the flux leaking around the outside of yoke 11' and entering copper collector 24' is quite small. Output polepiece 13' is at the same magnetic potential as yoke 11'.

Figure 3:
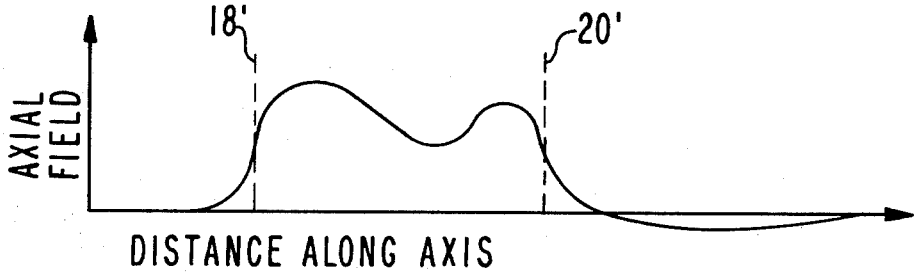
FIG. 3 is a schematic graph of the axial magnetic field strength of the structure of FIG. 2.

The difficulty with the magnet structure of FIG. 2 is that it is practically impossible to produce a uniform field between polepieces 12' and 13' when the field-generating magnet material 10' is all at one end of the structure. FIG. 3 is a schematic graph of the distribution of field strength along the axis. The axial positions of the beam-inlet aperture 18' and exit aperture 20' (FIG. 2) are indicated.

The tendency of the field to concentrate near beam-inlet aperture 18' and fall-off toward output aperture 20' is partly compensated by making the inner face 34 of input polepiece 12' to be concave and the face 36 of output polepiece 13' to be reentrant or convex. However, this compensation is only partial and still leaves a dip in field strength in the intervening gap.

Figure 4:
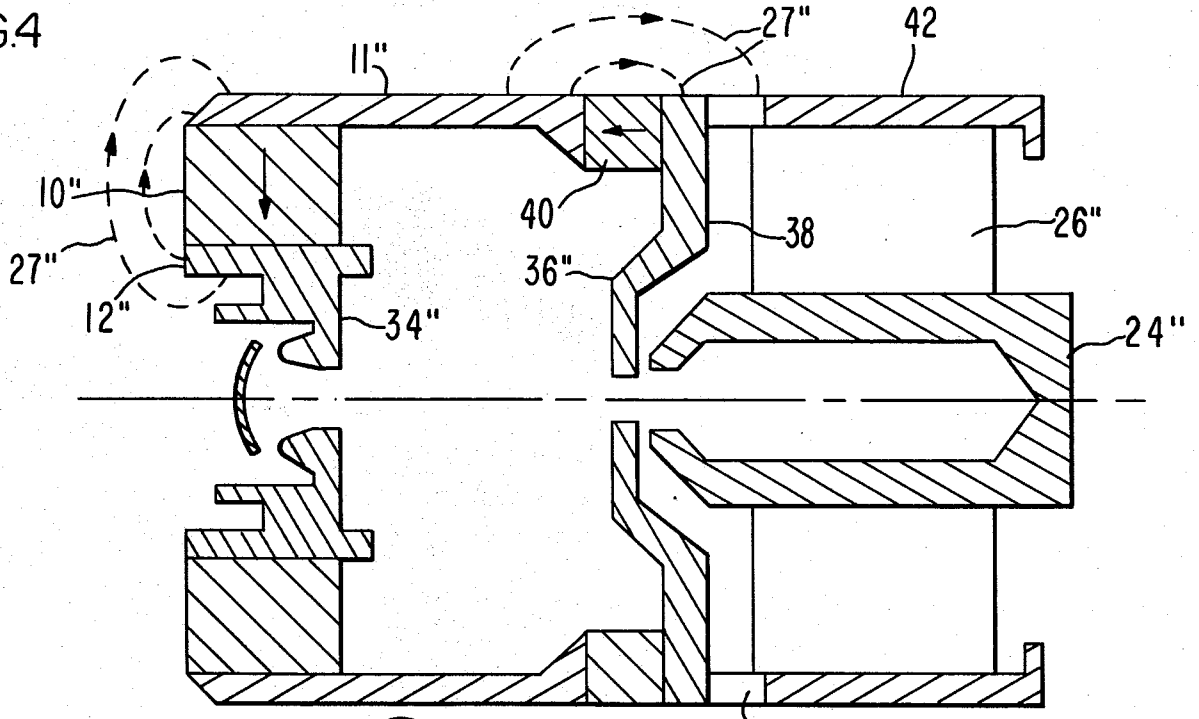
FIG. 4 is a schematic axial cross-section of a magnet structure embodying the invention.

FIG. 4 is a schematic axial section of a magnet structure embodying the invention. The cathode-end magnet 10'' is radially magnetized for optimum use of expensive magnet material. The collector polepiece 38 extends radially outward to the radius of flux-return yoke 11''. The collector-end annular magnet 40 is magnetized axially and extends axially from the end of yoke 11'' to polepiece 38.

The origin of outside leakage flux is thus at the outer radius of yoke 11'', considerably farther from collector 24'' than is the case with the radial magnet of FIG. 1. The leakage field strength inside collector 24'' is thus considerably reduced by the reduction in field with distance.

A further reduction may be achieved by providing a shield 42 of low-permeability metal outside of cooling fins 26''. Shield 42 is open at the top for entrance of cooling air and has a number of radially spaced openings 44 near its bottom end for air exhaust. Shield 42 extends to form magnetic contact with collector polepiece 38. It is not required to conduct heat so shield 42 may be massive enough to provide good magnetic shielding.

Another way to increase the shielding is to extend polepiece 38 to a greater outside radius. This, however, will increase the total leakage flux, requiring more magnet material.

As in FIG. 2, the inner faces 34'', 36'' of cathode polepiece 12'' and collector polepiece 38 are made respectively concave and convex. This allows more field generation by cathode magnet 10'' remote from collector 24'' and less by collector magnet 40 near collector 24''.

Figure 5:
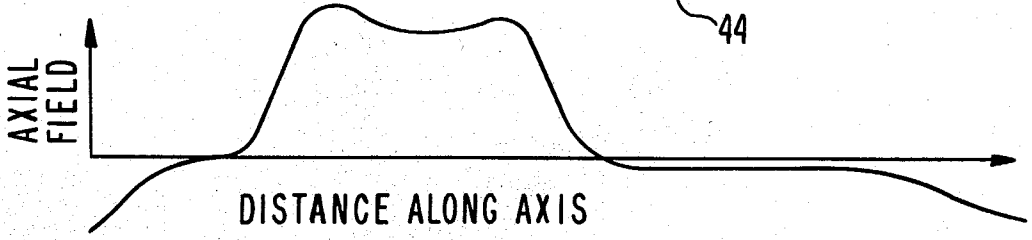
FIG. 5 is a schematic graph of the axial magnetic field strength of the structure of FIG. 4.

FIG. 5 is a plot of axial field strength obtained with the magnet structure of FIG. 4. It is essentially as good as that of the completely symmetrical structure of FIG. 1, and the collector field is greatly reduced.

The above described embodiments are illustrative and not intended to be limiting. Many different embodiments of the invention will be obvious to those skilled in the art. The invention is intended to be limited only by the following claims and their legal equivalents.

I claim:

1. A magnet structure for focusing a linear electron beam comprising:

two opposing polepieces of high-permeability metal separated along the direction of said beam and apertured for passage of said beam, a yoke of high-permeability metal surrounding said beam and extending between said polepieces, said yoke surrounding at least a part of a first of said polepieces, a first permanent magnet, magnetized substantially radially of said beam and extending between said yoke and said first polepiece, and a second permanent magnet, magnetized substantially parallel to said beam and extending in the direction of said beam between said yoke and said second polepiece.

2. The magnet structure of claim 1 wherein said second magnet is magnetized to induce flux in said yoke in the same direction as flux induced by said first magnet.

3. The magnet structure of claim 1 wherein said second polepiece extends radially of said beam to substantially the outer radial extent of said second permanent magnet.

4. The magnet structure of claim 1 further including a flux shield of high permeability metal surrounding said beam and extending in the direction of said beam from said second polepiece.

5. The magnet structure of claim 4 wherein said flux shield is in magnetic contact with said second polepiece.

6. The magnet structure of claim 4 wherein said flux shield is hollow to contain a collector for said beam.

7. The magnet structure of claim 5 wherein said flux shield is adapted to contain cooling fins extending outwardly from said collector.

8. The magnet structure of claim 6 wherein said flux shield is apertured for passage of coolant gas.

9. The magnet structure of claim 1, wherein said first permanent magnet is greater in size than said second magnet.

* * * * *